US006164467A

United States Patent [19]

DePottey et al.

[11] Patent Number: 6,164,467

[45] Date of Patent: Dec. 26, 2000

[54] FREE-STANDING MODULAR SLAT-WALL SYSTEM

[75] Inventors: Daniel D. DePottey, Zeeland; Daniel J. Muellerleile, Grand Haven; Ronald J. Friday, Muskegon; Vaninath Uppalapati, Portland, all of Mich.

[73] Assignee: Spectra Products Corporation, Grand Haven, Mich.

[21] Appl. No.: 09/125,671

[22] PCT Filed: Feb. 21, 1997

[86] PCT No.: PCT/US97/02987

§ 371 Date: Aug. 19, 1998

§ 102(e) Date: Aug. 19, 1998

[87] PCT Pub. No.: WO97/30612

PCT Pub. Date: Aug. 28, 1997

Related U.S. Application Data

[60] Provisional application No. 60/012,154, Feb. 23, 1996.

[51] Int. Cl.[7] ..... A47B 43/00; A47B 47/00

[52] U.S. Cl. ..... 211/189; 211/87.01; 211/94.01; 52/36.1; 52/36.4; 52/36.5; 52/489.2

[58] Field of Search ..... 52/36.1, 36.5, 52/126.3, 243, 481.2, 489.2, 763, 36.4, 36.6, 551, 588.1; 160/135; 211/87.01, 94.01, 189, 94.02

[56] References Cited

U.S. PATENT DOCUMENTS

| | | | |
|---|---|---|---|
| D. 178,937 | 10/1956 | Stiffel . | |
| D. 264,284 | 5/1982 | Nedermann . | |
| D. 279,201 | 6/1985 | Shuman . | |
| D. 330,646 | 11/1992 | Maas . | |
| D. 338,355 | 8/1993 | Wells . | |
| 1,913,342 | 6/1933 | Schaffert | 52/588.1 |
| 4,047,349 | 9/1977 | Aguilar | 52/511 |
| 4,055,253 | 10/1977 | Oztekin | 211/189 |
| 4,288,958 | 9/1981 | Chalmers et al. | 52/551 X |
| 4,323,163 | 4/1982 | Johns | 211/189 |
| 4,450,970 | 5/1984 | Shepherd | 211/189 |
| 4,607,753 | 8/1986 | Radek | 211/189 X |
| 4,805,783 | 2/1989 | Mayer | 211/189 X |
| 4,961,295 | 10/1990 | Kosch et al. | 211/94.5 X |
| 5,018,323 | 5/1991 | Clausen | 211/189 X |
| 5,255,803 | 10/1993 | Pavone et al. . | |
| 5,370,249 | 12/1994 | Harvey et al. | 211/189 |
| 5,412,912 | 5/1995 | Alves | 52/36.5 |
| 5,607,070 | 3/1997 | Hellyer . | |
| 5,653,349 | 8/1997 | Dana et al. | 211/189 |
| 5,941,026 | 8/1999 | Eisenreich et al. | 52/36.5 |
| 5,944,203 | 8/1999 | Vlah et al. | 211/189 |

*Primary Examiner*—Robert Canfield
*Attorney, Agent, or Firm*—Price, Heneveld, Cooper, DeWitt & Litton

[57] ABSTRACT

A free-standing modular wall system (10, 110) utilizing a plurality of individual slat members (22) stacked vertically one upon the other to form panels (12, 14) and supported upon upright end members (20) having a foot or base (16, 116) whereby the resulting module may be moved from place to place and joined with other such modules to form a longer wall. Preferably, the slats (22) are formed of sheet metal and mounted on transverse hanger brackets (24), to which some or all of the slat members (22) may be either fixedly or movably by interlocking slidable engagement. Preferably, the panels, (12, 14) consisting of slats (22) and hanger brackets (24) are removably mounted upon the upright supports (20). The modular wall system units (10, 110) may either be single-faced or double-faced, i.e., may have only a single slat-wall panel (12, 14) or may have a pair of such panels disposed back-to-back, for use in installations where both sides are fully exposed.

50 Claims, 5 Drawing Sheets

Fig. 1A
Fig. 1B
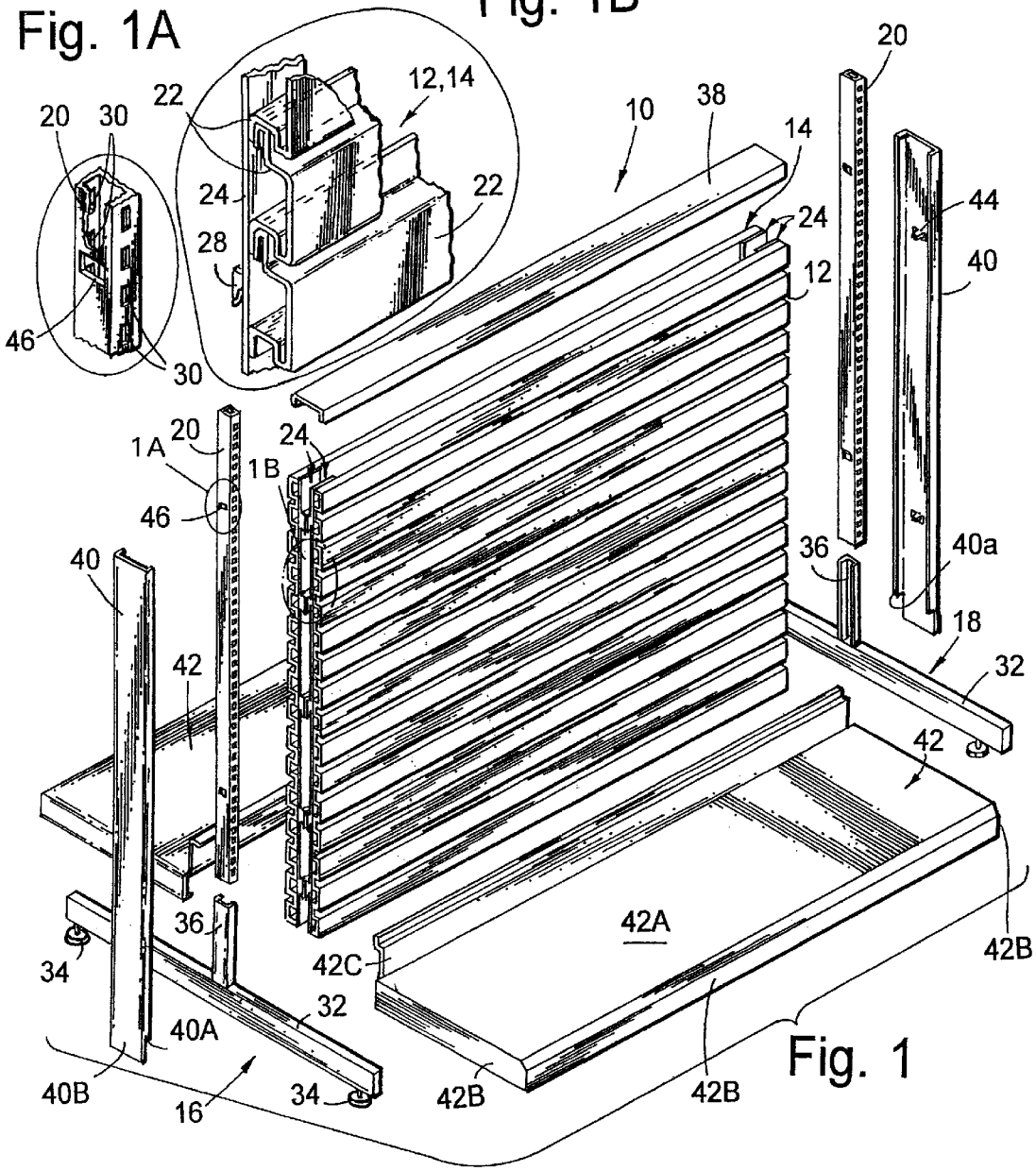
Fig. 1
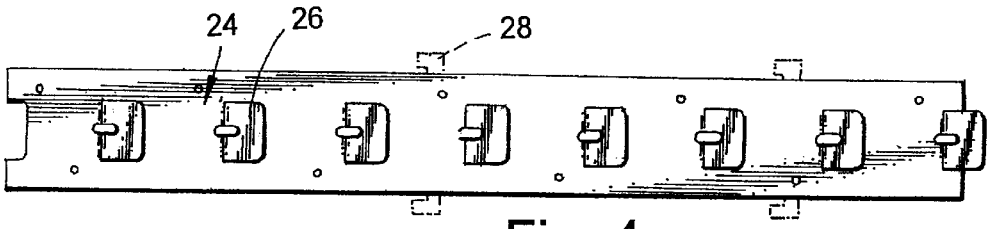
Fig. 4

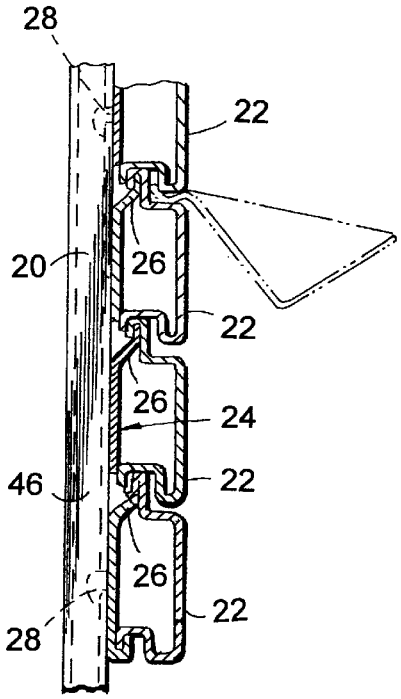
Fig. 10
Fig. 11
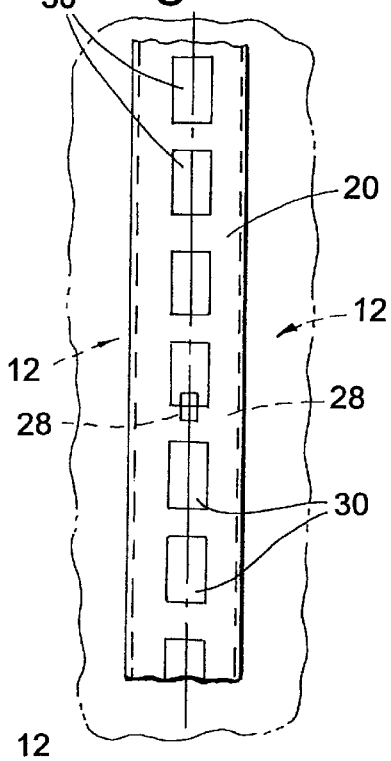
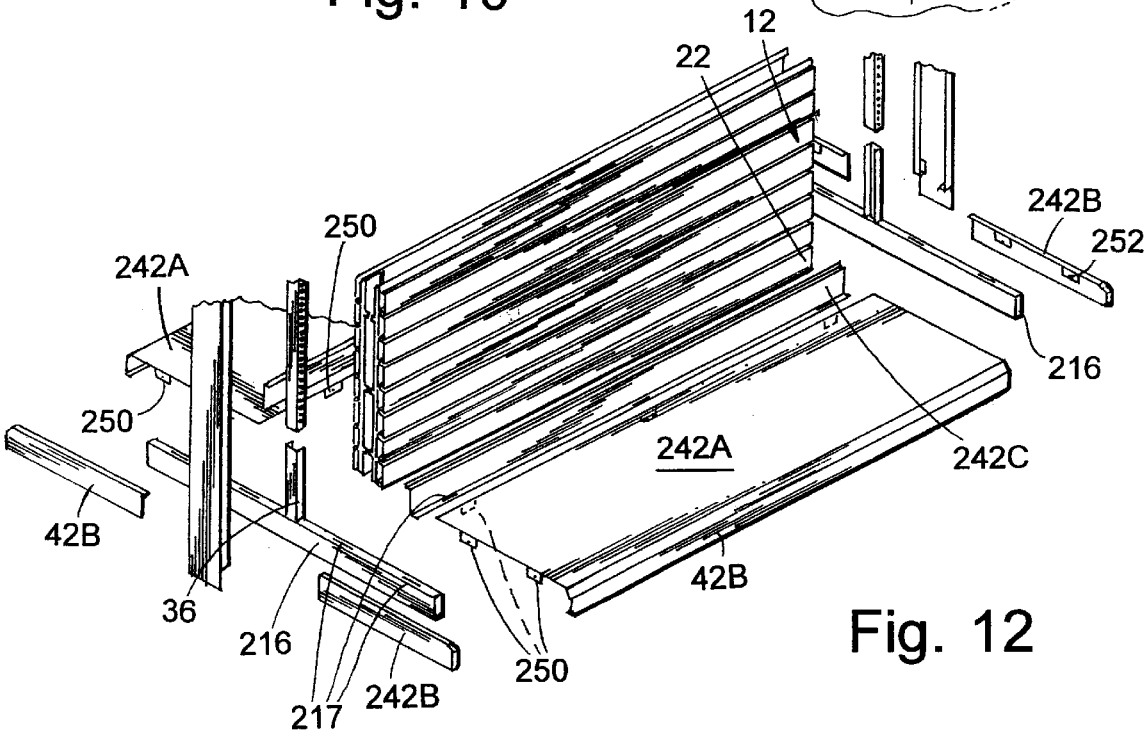
Fig. 12

FREE-STANDING MODULAR SLAT-WALL SYSTEM

This application is the National Stage of International Application No. PCT/US97/02987, filed Feb. 21, 1997, which claims the benefit of U.S. Provisional Application Ser. No. 60/012,154, filed Feb. 23, 1996.

BACKGROUND OF THE INVENTION

This invention relates to both free-standing modular wall systems and to slat-wall systems, and more particularly relates to novel integrated forms of such wall systems. More particularly, this invention relates to free-standing, self-supporting walls or panels, and especially to such walls or panels as are made from a plurality of assembled individual slats. Still more particularly, and in a particular preferred embodiment, the invention relates to free-standing, modular wall systems of the type just noted which utilize the profiled sheet metal slats and elongated slat hanger and support members which are the subject of prior U.S. Pat. No. 4,961,295, issued Oct. 9, 1990 entitled "METAL SLAT AND WALL SYSTEM UTILIZING SAME." This prior patent is principally addressed to a slat-wall system which utilizes a plurality of elongated metal slats of particular profiled cross section which are disposed generally horizontally and mounted upon orthoginally disposed support hanger strips that are vertically aligned and secured to a pre-existing fixed wall structure, or at least to pre-existing fixed vertical supports for a wall, such as the upright studs used in conventional building structures or the like.

According to present practices, retailers and other such sellers of goods frequently use display walls, upon which various supports, shelves, etc. may be secured, to display articles of merchandise which are for sale. Typically, such walls are secured to the existing fixed interior walls, either around the perimeter or across desired parts of the building interior. Also, merchants frequently use free-standing, modular space-divider walls of considerably shorter length and often of only moderate height, for displaying merchandise or advertising, etc., and for guiding the flow of traffic, as well as other purposes. Sometimes, these free-standing, modular walls are referred to as "gondolas", and are readily movable, either by sliding or upon rollers or wheels. Usually, such structures are of relatively simple construction, having feet elements of a size and shape as to support a relatively simple planar upper extremity, which may for example merely consist of a sheet of desired material, for example, peg board, "hardboard" or the like. Typically, the aforementioned fixed walls are structurally integrated with the building and not readily modified. Conversely, the movable "gondola" walls are typically of relatively insubstantial construction and, while movable, not capable of supporting any substantial weight and not readily subject to modification. In most cases, and except for metal slat-wall systems such as those referred to above in connection with prior U.S. Pat. No. 4,961,295, both the fixed and the movable type of presently used display/divider walls systems lack strength, are subject to being marred or damaged readily, and most importantly are readily combustible, thus presenting fire hazard considerations

SUMMARY DESCRIPTION OF THE INVENTION

The present invention provides a significant advance in the present state of the display/room divider wall art, which greatly reduces or eliminates various of the shortcomings and disadvantages noted above with respect to conventional such systems.

Generally considered, the present invention provides a free-standing and movable wall system which incorporates metal slats of the general type addressed by prior U.S. Pat. No. 4,961,295, to provide a modular and self-supporting structure which does not require preexisting walls or supports and which may thus be used independently, in the manner of a space-divider, facade, facia, or display wall, etc. Further, the present invention provides such a wall structure in the form of individual sections or modules which may be used together seriatim to define continuous walls, closures within a larger area, etc. Thus, the present free-standing slat-wall system is ideally suited for such uses as a display wall, exhibit wall, store-fixturing, storage, partitions, sound-deadening, signage, laboratory or workspace division, traffic-directing panel, etc.

A particular advantage of the present invention is the fact that the wall extremity which is made up of the aforementioned individual slats or grouping thereof has or may have essentially any desired vertical extent, since any given number of individual slats, or of slats secured together as a unit in the nature of an assembled panel, may be used in any desired combination of widths (i.e., heights) and lengths. Further, such unitary panels made up of rigidly coupled individual slats posses high strength and rigidity (being non-wracking), and may be made up of practically any desired number of separate individual slats. In either case, the slats link together by inter-engagement with one another, and/or with the integrated and mutually secured unitary slat panel structure just noted. In this manner, a wide variety of decorative and structural effects may be obtained, as well as considerable added versatility for the overall system from the standpoint of height, etc. Similarly, several units of the mutually-connected slat panels may be stacked upon one another and secured to the same vertical support structure, in modular form, to produce walls of varying heights. Of course, a substantial benefit of all such arrangements is the fact that the most preferred form of the invention incorporates metal slats and metal hanger structures, which possess considerable structural strength and which are essentially non-flammable.

BRIEF DESCRIPTION OF THE DRAWINGS

FIG. 1 is an exploded perspective view of a double-sided free-standing modular wall system in accordance with the invention, with certain fragmentary portions enlarged and shown separately as FIGS. 1A and 1B to illustrate structural details;

FIG. 4 is a top plan view showing a preferred form of slat hanger element;

FIG. 10 is a fragmentary side elevational view similar to FIG. 8 but showing the assembled wall on an enlarged scale and mounted upon an upright support.

FIG. 11 is an enlarged fragmentary front elevational view of an upright support member on which a pair of slat wall assemblies is mounted in side-by-side relation; and FIG. 12 is a fragmentary exploded perspective view showing an alternative embodiment of the subject matter of FIGS. 1 and 2.

DETAILED DESCRIPTION OF PREFERRED EMBODIMENTS

Figure 2:
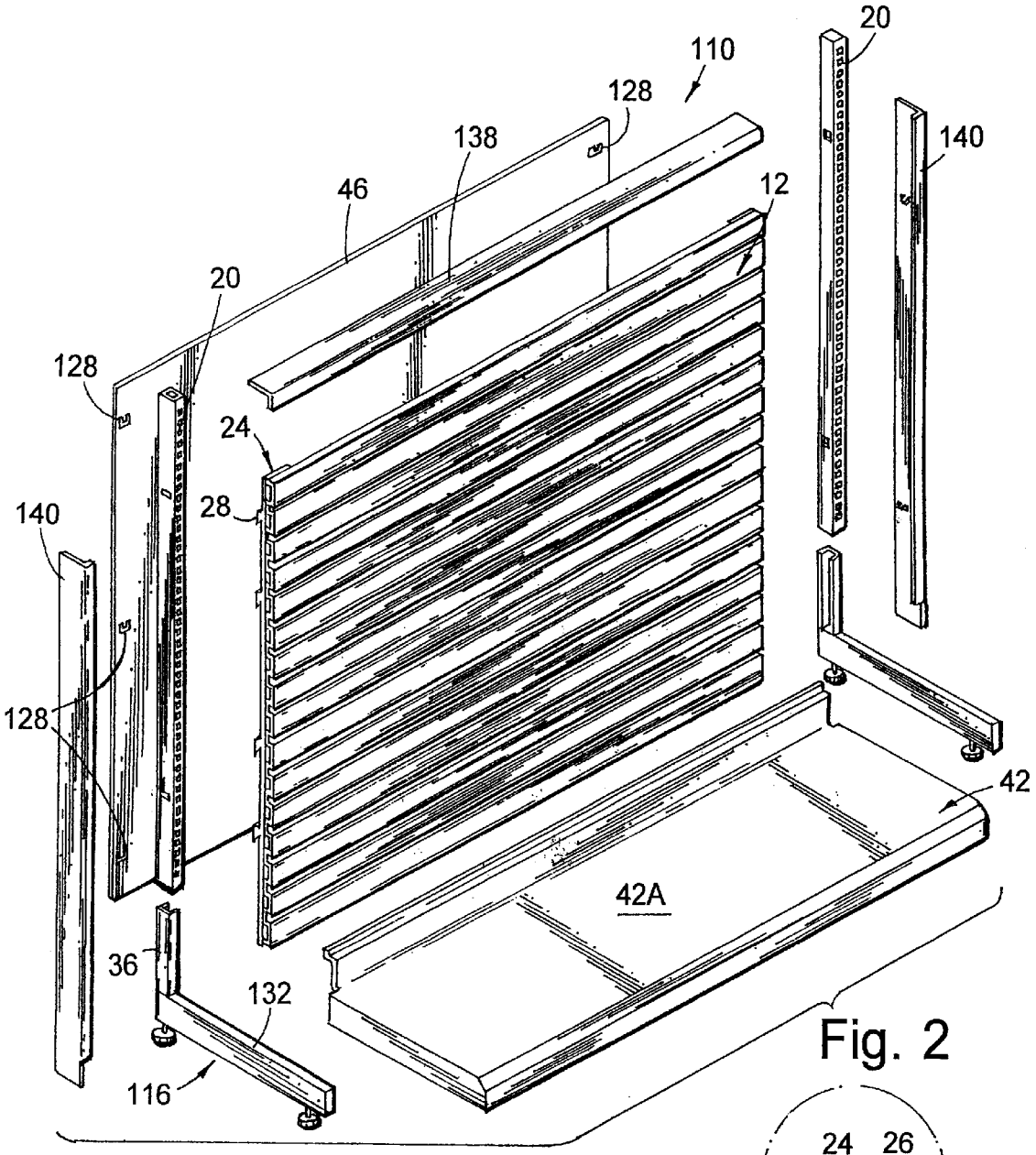
FIG. 2 is an exploded perspective view similar to FIG. 1 but showing a single-sided wall system.

Referring now in more detail to the drawings, FIG. 1 illustrates a first preferred embodiment of the invention, designated generally by the numeral 10, which includes a pair of panel-like slat-wall structures 12 and 14 respectively, shown in a back-to-back disposition, together with the various structural elements which support the slat-wall structures 12, 14 in the upright position shown, in a free-standing manner. This support structure includes a pair of substantially identical feet or base portions 16, 18 which receive and securely hold a pair of upright supports 20, upon which the two slat-wall structures 12 and 14 are mounted. More particularly, each of the feet or the base portions 16, 18 includes a beam-like main support bar 32, which preferably comprises rigid metal tubing of rectangular or other cross-section. Each such main support bar includes a foot element 34 at each end that may consist of a rounded or other glide 34, or a desired type of roller, for example, a castor. The main support bars 32 extend horizontally and generally bear the weight of all of the other components, i.e., the upright supports 20, slat-wall panels 12, 14, etc. Preferably, each of the main support bars 32 has an upstanding mounting element 36 secured centrally thereto, as by welding, and each of these has a cross-section corresponding essentially in size and shape to the interior opening in the upright supports 20, which are preferably made from strong rectangular metal tubing. Thus, each of the upright supports 20 slides down over one of the mounting elements 36 to form a separable but strong and rigid mechanical structure. The mounting elements 36 may also be of rectangular metal tubing, or of channel stock.

Figure 8:
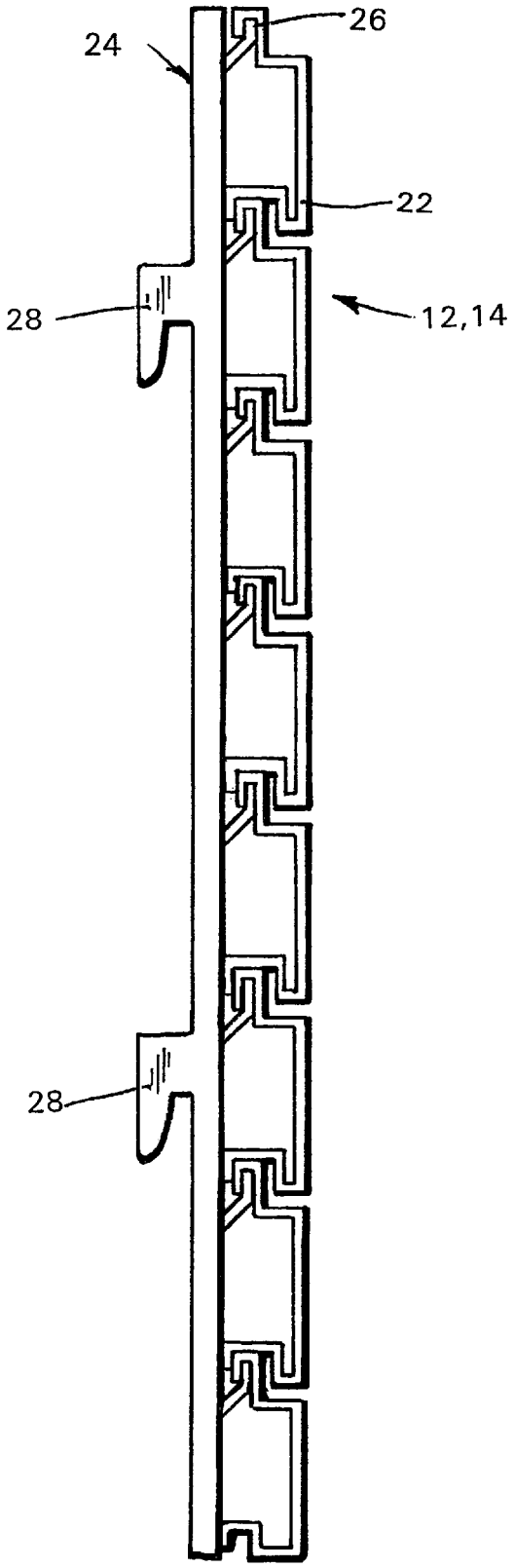
FIG. 8. is a side elevational view of the assembled wall shown in FIG. 5.

Each of the slat-wall structures 12, 14 comprises a vertically stacked series of individual slats 22, which nest or interfit one upon another in the manner illustrated in FIGS. 1B, 8, and 10 and as shown and described in further detail in the above-mentioned, referenced prior U.S. Pat. No. 4,961,295. An upright hanger bracket 24 extends vertically along the rear side of each such panel at each side, i.e., at the ends of the slats 22 and these may also be used at other points along the slats where desired or necessary for additional strength. The hanger brackets 24 are also preferably as illustrated and described in earlier U.S. Pat. No. 4,961,295, and are illustrated in somewhat more detail in FIGS. 4, 5, 9, 10, and 11. As shown, each such bracket 24 preferably includes a series of upwardly projecting, laterally offset tab members 26 which are formed by cutting the hanger bracket 24 along three sides of each tab and then bending the resulting free portion laterally, preferably by lancing during a stamping operation. Each of the tabs 26 project upwardly and fit into the recess along the bottom of each of the slats 22 which receives the projecting upper portion of the slat 22 disposed immediately below; consequently, the slats 22 not only nest together one upon another, but also nest upon the projecting support tabs 26, to be supported in place thereupon (i.e., hung upon), thereby forming an integrated structure (as set forth in more detail in U.S. Pat. No. 4,961,295).

In accordance with the present invention, all or a selected lesser member of the slats 22 in each panel 12, 14 are also fixed in place upon their respective hanger bracket 24, as by welding or other suitable such means (including adhesive), to form a fixed panel-like assembly. For example, each instance of the interengaged tabs 26 and interengaged top and bottom flanges of an adjoining pair of the slats 22 may simply be welded together, from the back of the structures 12 and 14. In this manner, a rigidly connected and permanent wall panel is formed which is not subject to wracking as a result of laterally directed loading etc., which might otherwise cause sliding of the nested slats upon one another and upon their respective hanger brackets, as may occur with free slats.

Figure 6:
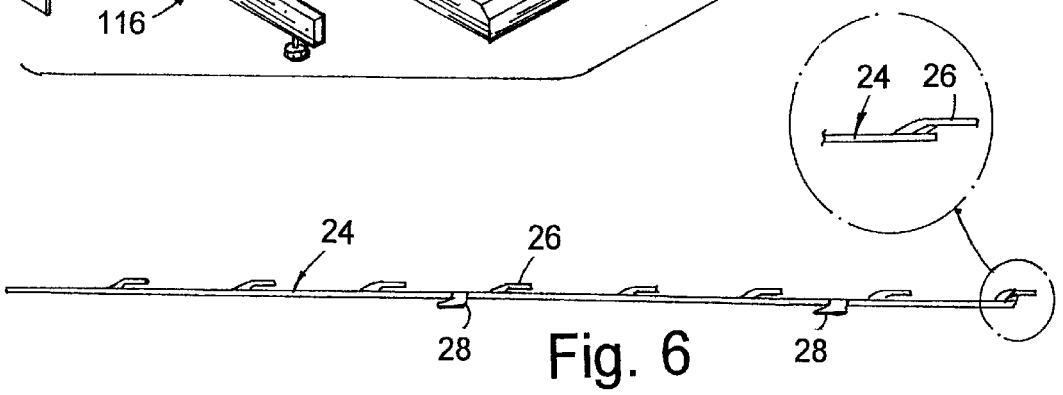
FIG. 6 is a side elevational view of the hanger element shown in FIG. 4, including a portion shown in enlarged scale for added detail.
Figure 7:
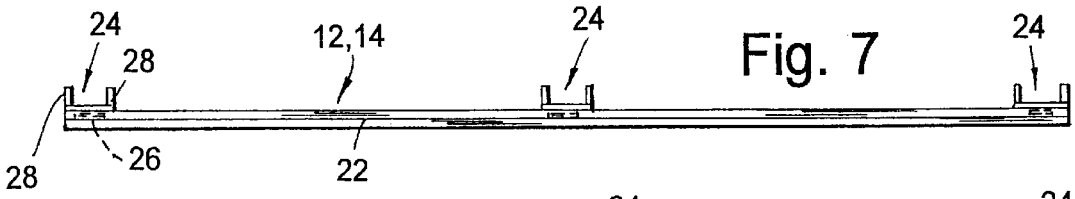
FIG. 7 is an overhead plan view of the assembled modular slat-wall shown in FIG. 5.
Figure 5:
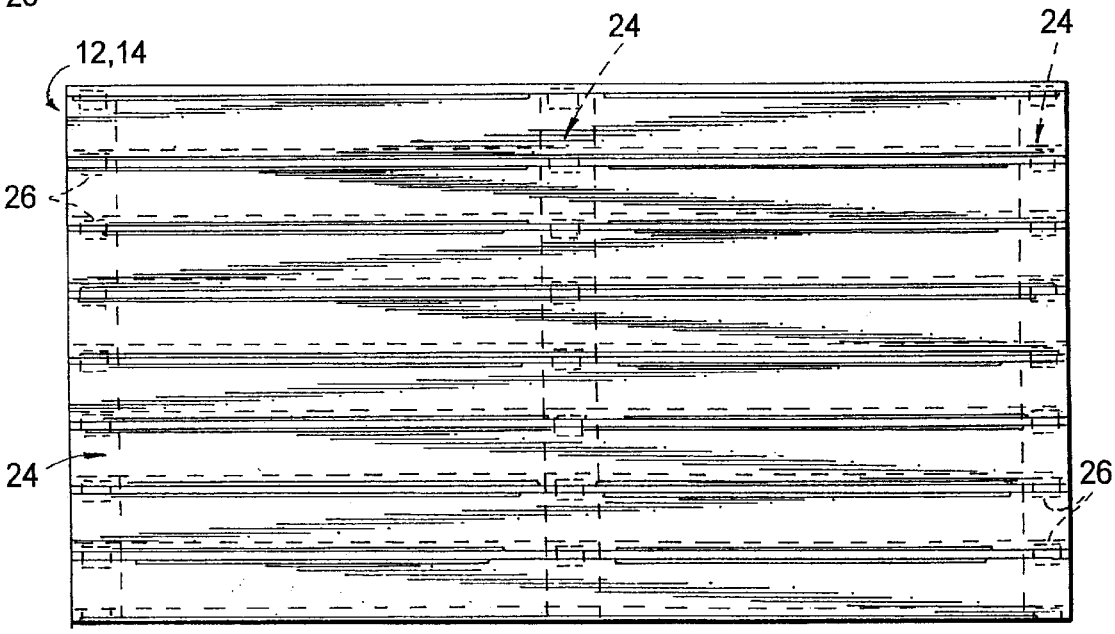
FIG. 5 is a side elevational view showing an assembled modular slat-wall panel in accordance with the invention.

In the form of the invention illustrated in FIG. 1 and discussed above, each of the hanger brackets 24 disposed at the ends of the slat-wall panels 12, 14 has a series of mutually spaced downwardly extending hooks 28 (best shown in FIGS. 6 and 10, but also visible in FIG. 1, FIG. 1B, and FIG. 4). The hooks 28 provide a preferred structure by which the slat-wall panels 12, 14 are mounted upon the upright supports 20. That is, as best shown in FIG. 1A, each of the upright supports 20 has a series of openings 30 spaced at intervals corresponding to that of the hooks 28, which are of a size to admit the hooks 28. When so inserted, hooks 28 may then be moved downward (by corresponding movement of the hanger brackets 24 and attached slats), to hook behind the respective openings 30 and thereby securely hold the integrated slat-wall structures 12, 14 in their respective vertical position. In the FIG. 1 embodiment, each of the upright supports 20 has a series of the hook-receiving openings 30 along each of its two opposite sides, so that the slots or openings 30 on one side of the upright support 20 will receive the hooks 28 of slat-wall panel 12, and the slats 30 on the opposite such side of that upright support 20 will receive the hooks 28 of slat-wall panel 14. In this regard, it may or may not be desired to include a hanger bracket 24 or other such vertical reinforcement in other locations between the ends of the slat-wall panels 12, 14 (as generally shown in FIG. 5), depending upon the overall length of each of the slats 22 (i.e., the overall width of the slat-wall panels 12 and 14), and it may or may not be desirable to have such intermediate supports include hooks 28, along with additional upright supports 20 (and corresponding bases 16) as intermediate load-bearing structures; however, each such variation is clearly within the overall scope of the present invention.

The assembled unit as just described preferably includes certain finishing or trim pieces, including a top cover 38, end covers 40, and apron-like foot covers or decks 42, whose nature and general assembly will be apparent from FIG. 1. That is, the top cover 38 and end covers 40 may comprise channel-shaped decorative pieces of plastic, metal, etc. which simply fit over the top or ends of the two mounted slat-wall panels 12 and 14, to provide a finished and attractive appearance. Similarly, the foot covers 42 include a main deck portion 42A and depending side walls 42B on three sides, shaped and sized to fit over and cover the outwardly extending portions of the two opposite support bars 32 on one side of the assembly 10, covering the entire area therebetween. Preferably, the foot covers 42 also include an upright panel proportion 42C along the rearward edge which interfits with the lowermost slat in the panel (for example, in the same way as each of the slats 22 interfits with the one above it), thereby providing a continuous panel surface from the vertical portion to the horizontal deck portion. To augment the retention of the end covers 40, each may include a desired number of tabs or resilient catches 44 which fit into corresponding slots 46 in the lateral sides of the uprights 20. Also, each of the side or end covers 40 preferably has its side walls 40A trimmed away or otherwise omitted at the bottom, to leave a flat downwardly extending main portion 40B which extends over and conceals the juncture of the mounting elements 36 and the main support bar 32.

The embodiment 110 of the invention illustrated in FIG. 2 will readily be seen to comprise essentially one-half of the double-sided structure 110 of FIG. 1, and uses the same basic components. Where the components are actually the same, they are given the same number as those used in FIG. 1; where they are directly similar, but not precisely the same, they are given the same number with the prefix "1". Side-by-side comparison of the apparatus shown in FIGS. 1 and 2 will readily reveal their commonality, as well as their differences. The principal such difference is, of course, that the device 110 is only single-sided, in that it has only a single one of the slat-wall panels 12, and the main support bar 132 of the foot 116 extends in only one direction from the mounting element 36. Where such single-sided devices are used adjacent an existing wall, their rear side need not be covered at all; however, where they are used in open circumstances, where their rear side is visible, it is desirable to cover that side with a concealment panel 46 of any desired nature, e.g., a painted or fabric-covered thin panel of metal, hardboard, etc. In order to retain the concealment panel 46 in the desired position, it may have hanger brackets 24 secured to each side in order to provide projecting hooks 28 engageable with the slots 30 in upright 20, as seen in FIG. 1, or it may simply have a series of clips or tabs 128 which extend toward and engage the slots 30 in the adjacent side of upright 20. In this type of arrangement, the top and side covers 138, 140 may be of L-shaped cross section rather than the generally C-shaped channels used in the FIG. 1 embodiment, since there is only one slat-wall panel 12 whose top and edges are to be covered, the opposite sides of the cover members 138, 140 simply abutting or overlapping edges of the panel 46.

FIG. 12 illustrates a variation applicable to either of the embodiments 10 or 110 discussed above, wherein the deck structure 42A, 42B, and 42C of FIGS. 1 and 2 is in the form of separate elements, here designated by the corresponding numbers 242A (of which portion 42B is shown as an intergral part), 242B and 242C. In this form, the upright portion 42C is a slat-like element 242C which preferably interfits with the lowest slat 22 in the same general way as each such slat interfits with the one above it. Element 242C has a generally horizontal flange along its bottom which fits under deck portion 242A and has a series of slots 217 which receive downwardly extending tabs 250 on deck portion 242A to interlock these parts. Similarly, deck portion 242A has tabs 250 which fit into slots 217 of the feet or base portions 216, to interlock these portions together. Finally, the foot cover portions 242B may also be separate cap-like members which cover the side and part or all of the top of foot element 216, preferably having tabs 252 which fit into slots 217 alongside the tabs 250 of deck 242A. As will be understood, the tabs 250 and 252 maybe located at the edge of portions 242A and 242B or inwardly of the edge to position these latter portions in desired particular relative educations, e.g., abutting or overlapping.

It should be expressly pointed out that each of the modules 10 or 110 may be used separately, by itself, or may be disposed side-by-side with other such modules in order to form a more extensive (longer) wall. When disposed side-by-side, the contiguous sides of each two adjacent units need not employ the covers 40, 140, since the contiguous sides will directly match one another and lie in substantially continuous contact, to present the appearance of a continuing wall. In this regard, one noteworthy aspect of the modular, free-standing structure is that the slots 30 in the uprights 20 are preferably wide enough to admit the hooking portions 28 of each of a pair of directly adjacent slat-wall panels 12 or 14, with both such adjacent panels thereby sharing a single one of the uprights 20, and a single one of the foot or base portions 16, 116 (see FIG. 11). This not only saves the cost of materials which would be involved in having two adjacent fully independent such units, but also greatly facilitates the assembly, appearance, and ultimate usage of such continuing wall sections. In particular, with each two adjoining panel units 12 or 14 sharing a single upright 20, the resulting assembly is locked together, such that the two adjacent modules may not be separated inadvertently, or pulled apart.

Figure 9:
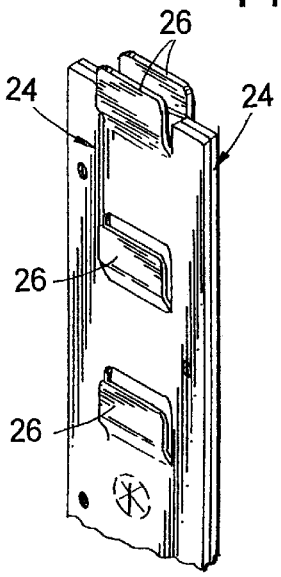
FIG. 9 is an enlarged fragmentary perspective view showing one end of a slat hanger structure generally as shown in FIGS. 4 and 6, but having a pair of hanger elements secured to one another in back-to-back relation.

In the modification shown in FIG. 9, two of the hanger brackets 24 are secured back-to-back, for supporting a pair of the panel assemblies 12, 14 in back-to-back closely spaced disposition. In such an arrangement, the two such hanger brackets may if desired or necessary be made from heavier stock, so as to add more structural strength and rigidity, and the resulting bi-directional support member may be mounted or supported in a vertical position in any number of ways, e.g., secured directly to or resting upon a foot or base portion 16, 18, or by seating in an appropriately sized top aperture in the main support bar 32 thereof, or in a variety of other ways. As in the embodiments discussed above, some or all of the slats 22 used in this embodiment may be fixedly secured to the hanger brackets in addition to resting upon them, to thereby form an integrated unitary panel structure which in this case would be double-sided.

It should be pointed out that the unitary fixed-slat panels disclosed in the embodiments described above may also be supported in position by various means other than the hanger brackets and upright supports of the preferred embodiments. One example of such an arrangement is the use of such integral, unitary slat panels to retrofit existing installations while other types of panels have been used, e.g., pegboard, wall board, pre-finished hardwood sheets, etc. In many such case the existing panels rest in slots or grooves in the adjacent sides of upright supports, and the panels may thus be slid out of place, removed, and replaced by unitary slat panels in accordance with the present invention, which may either be slid directly into the existing slots (with or without the end caps or covers), or else be equipped with end covers having an external ridge or projection which approximates the thickness of the panel being retrofitted and is slidable into the same grooves. For double-sided such applications, the embodiment according to FIG. 9 may be very useful.

Figure 3:
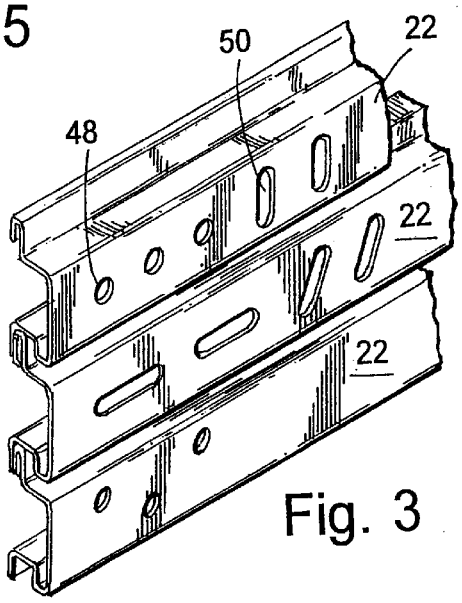
FIG. 3. is an enlarged fragmentary perspective view showing certain optional features of slats usable in practicing the invention.

In a broad sense, the slats 22 may be made of non-metal materials (e.g., plastic, etc.), and may have configurations and/or mounting structures which differ from those of the aforementioned earlier U.S. patent. Further, as illustrated in FIG. 3, any or all of the individuals slats 22 may include a plurality of apertures 48, 50 which are adapted for use with known types of receivable support members in the nature of a "peg board" wall or panel. As will be understood, the apertures 48, 50 should be shaped to accommodate whatever type of "pegs" are to be used, which are typically in the nature of hooking elements made from rod-like stock, strap-like material, etc., and the apertures 48 and 50 should of course be positioned at whatever spacing is desired or necessary. In addition to receiving and supporting such peg-type or other hanger elements, the apertures 48 and 50 may also be used to support a decorative or other such front panel cover (not specifically illustrated) which, for example, may be similar to the panel 46 discussed previously, or of other types intended for other particular purposes, e.g. decoration, signage, sound-deadening, light-reflecting or diffusing, etc. In fact, the apertures 48, 50 may even be used for decorative purposes themselves, for example, by having particular individual shapes and/or being arranged in desired patterns or groupings. In addition, any desired number of slats 22 at the top or bottom of each panel 12 may be left unsecured (i.e., not fixed by welding, etc.) to the vertical hanger bracket 28, and merely rest upon the tabs 26 thereof, so as to be replaceable and interchangeable, for decorative purposes or otherwise.

As will be seen from the foregoing, the present free-standing modular slat-wall system provides a structure and apparatus not previously available, which is strong and secure, exceedingly stable, and yet which is readily movable as the unit. As discussed above, the basic structure is exceedingly versatile, in that certain of the slats may be either fixedly secured together or left mutually separate but interlinked, so as to be dismountable and replaceable. Each of the slats may be given any number of different decorative surface treatments, including paint, powder-coat, plastic sheet (having desired colors and patterns, including woodgrain) etc., or basic metal finishes may also be used, including brushed, shot-peened or other textured metal treatment, etc.

It is to be pointed out once again that while the foregoing disclosure addresses a particular preferred embodiment, and best mode, the particular apparatus described and the various detailed aspects thereof noted are regarded as pertaining to only the most preferred version of the invention and to merely illustrate the principles and concepts involved in the invention, other embodiments and versions of the invention no doubt being feasible and potentially appropriate in other circumstances. It is therefore to be understood that the foregoing description of a particular preferred embodiment is provided for purposes of description and illustration, and not as a measure of the invention, whose scope is to be defined solely by reference to the ensuing claims. Embodiments of the invention differing from those set forth above which nonetheless utilize the underlying concepts of the invention and incorporate its spirit should therefore be considered as within the scope of the claims appended below, unless such claims by their language specifically state otherwise.

The embodiments of the invention in which an exclusive property or privilege is claimed are defined as follows:

1. A free-standing, modular slat-wall structure, comprising in combination:

at least two mutually spaced upright supports, each having foot structure for supporting it in an upright position;

a plurality of individual slat members stacked one upon another in generally vertical alignment, at least some of said slat members being fixedly secured together to form a unitary panel-like member; and attachment apparatus for attaching said plurality of slat members to each of said at least two mutually spaced upright supports to form a free-standing slat-wall structure of a modular nature which is movable as a unit;

including a plurality of said vertically stacked slat members disposed on each of a pair of opposite sides of said upright supports, whereby said modular slat-wall structure is double-sided.

2. A modular slat-wall structure as recited in claim 1, wherein at least one of said individual slat members is removably coupled to said fixedly secured slat members which form said unitary panel-like member.

3. A modular slat-wall structure as recited in claim 1, wherein said attachment apparatus hangs at least some of said slat members upon said upright supports with a removable connection, thereby making such slat members removable and interchangeable with other such slat members.

4. A modular slat-wall structure as recited in claim 1, wherein said attachment apparatus hangs said unitary panel-like member upon said upright supports with a removable connection, thereby making said member removable and interchangeable with other such panel-like members and with individual slat members.

5. A modular slat-wall structure as recited in claim 1, wherein said attachment apparatus includes an elongated member extending generally transversely across at least some of said slat members and contacting such slat members to support them in place relative to one another.

6. A modular slat-wall structure as recited in claim 5, wherein said elongated member includes projecting portions which are engageable with said at least some of said slat members to support them in place.

7. A modular slat-wall structure as recited in claim 5, wherein said elongated member includes hanger portions which are movably engageable with cooperating portions of said at least of some said slat members.

8. A modular slat-wall structure as recited in claim 5, wherein said elongated member is fixedly secured to at least certain of said at least some of said slat members to form said unitary panel-like member.

9. A modular slat-wall structure as recited in claim 8, including a mechanical fastening structure between said elongated member and said certain of said slat members to fixedly secure them together.

10. A modular slat-wall structure as recited in claim 9, wherein said mechanical fastening structure comprises a weld.

11. A modular slat-wall structure as recited in claim 9, wherein said mechanical fastening structure comprises an adhesive.

12. A modular slat-wall structure as recited in claim 5, wherein said elongated member includes at least one of a pair of mutually engageable hanger structures and at least one of said upright supports includes the other of said pair of hanger structures, said pair of hanger structures when so engaged serving to support the slat members which are contacted and supported by said elongated member.

13. A modular slat-wall structure as recited in claim 1, wherein said upright supports comprise a pair of back-to-back interconnected elongated members extending generally transversely across at least some of said slat members and contacting such slat members to support them in place relative to one another.

14. A modular slat-wall structure as recited in claim 1, including a cover member extending vertically along and over the adjoining edges of at least said plurality of vertically stacked slat members, to cover and conceal such edges.

15. A modular slat-wall structure as recited in claim 14, wherein said cover member extends along and over the adjoining edges of at least some of said vertically stacked slat members and their respective attachment apparatus and upright supports.

16. A modular slat-wall structure as recited in claim 1, including a cap-like cover member extending along and over the top portions of said upright supports and vertically stacked slat members to substantially cover and conceal such top portions.

17. A modular slat-wall structure as recited in claim 1, wherein said foot structure includes a leveler apparatus for adjusting the relative height of the associated upright support and structure connected thereto.

18. A modular slat-wall structure as recited in claim 1, wherein said foot structure includes a glide element on its bottom for facilitating movement of the associated upright support and structure connected thereto.

19. A modular slat-wall structure as recited in claim 1, wherein said foot structure includes a roller element on its bottom for facilitating movement of the associated upright support and structure connected thereto.

20. A free-standing, modular slat-wall structure, comprising in combination:

at least two mutually spaced upright supports, each having foot structure for supporting it in an upright position;

a plurality of individual slat members stacked one upon another in generally vertical alignment, at least some of said slat members being fixedly secured together to form a unitary panel-like member;

attachment apparatus for attaching said plurality of slat members to each of said at least two mutually spaced upright supports to form a free-standing slat-wall structure of a modular nature which is movable as a unit;

a deck-like panel extending between and substantially covering the foot structure of each of said at least two mutually spaced upright supports at a position below said vertically stacked slat members; and wherein said deck-like panel includes portions which extend along the lowermost extremity of the lowermost slat member.

21. A free-standing, modular slat-wall structure, comprising in combination:

at least two mutually spaced upright supports, each having foot structure for supporting it in an upright position;

a plurality of individual slat members stacked one upon another in generally vertical alignment, at least some of said slat members being fixedly secured together to form a unitary panel-like member;

attachment apparatus for mounting said plurality of slat members upon said at least two mutually spaced upright supports to hang said slat members upon said at least two upright supports and form a free-standing slat-wall structure of a modular nature which is movable as a unit; and a cover member extending vertically along and over the adjoining edges of at least some of said plurality of vertically stacked slat members, to cover and conceal such edges.

22. A modular slat-wall structure as recited in claim 21, wherein said cover member extends along and over the adjoining edges of said at least some of said vertically stacked slats and of their respective attachment apparatus and upright supports.

23. A free-standing, modular slat-wall structure, comprising in combination:

at least two mutually spaced upright supports, each having foot structure for supporting it in an upright position;

a plurality of individual slat members stacked one upon another in generally vertical alignment, at least some of said slats being fixedly secured together to form a unitary panel-like member;

attachment apparatus for attaching said fixedly secured slat members to each of said at least two mutually spaced upright supports to hang said fixedly secured slat members upon said upright supports and form a free-standing slat-wall structure of a modular nature which is movable as a unit; and a mechanical fastening structure between said attachment apparatus and at least one of said slat members to fixedly secure them together.

24. A free-standing, modular slat-wall structure, comprising in combination:

at least two mutually spaced upright supports, each having foot structure for supporting it in an upright position;

a plurality of individual slat members stacked one upon another in generally vertical alignment, at least some of said slat members being fixedly secured together to form a unitary panel-like member; and attachment apparatus for attaching said plurality of slat members to each of said at least two mutually spaced upright supports to form a free-standing slat-wall structure of a modular nature which is movable as a unit; and wherein at least one of said at least two upright supports and said attachment apparatus include mutually engageable elements for attaching the plurality of slat members of each of a pair of adjacent such modular slat-wall structures to the same upright support in close side-by-side relation, thereby linking such pair of adjacent modular slat-wall structures together and forming a longer resultant wall.

25. A free-standing, modular slat-wall structure, comprising in combination:

at least two mutually spaced upright supports, each having foot structure for supporting it in an upright position;

a plurality of individual slat members arranged one upon another in generally vertical alignment, at least some of said slat members being connected together to form a panel-like structure; and attachment apparatus for attaching said slat members to each of said at least two upright supports to form a free-standing structure of a modular nature which is movable as a unit; and wherein at least one of said at least two upright supports and said attachment apparatus include mutually engageable elements for attaching the plurality of slat members of each of a pair of adjacent such modular slat-wall structures to the same upright support in close side-by-side relation, thereby linking such pair of adjacent slat-wall structures together and forming a longer resultant wall.

26. A modular slat-wall structure as recited in claim 25, wherein at least one of said slat members is removably connected to the others.

27. A modular slat-wall structure as recited in claim 25, wherein said attachment apparatus mounts at least some of said individual slat members upon said upright supports with a removable connection, thereby making such slat members removable and interchangeable with other such slat members.

28. A modular slat-wall structure as recited in claim 25, wherein said attachment apparatus includes an elongated member extending generally transversely across at least some of said slat members and contacting such slat members to support them in place relative to one another, and wherein said elongated member includes hanger portions which are engageable with cooperating portions of said at least some of said slat members to support them in place.

29. A modular slat-wall structure as recited in claim 28, wherein said elongated member includes at least one of a pair of mutually engageable hanger elements and at least one of said upright supports includes the other of said pair of hanger elements, said pair of hanger elements when so engaged serving to support the slat members which are contacted and supported by said elongated member.

30. A modular slat-wall structure as recited in claim 25, including a deck-like panel extending between and substantially covering the foot structure of each of said pair of mutually spaced upright supports beneath said vertically arranged slat members.

31. A modular slat-wall structure as recited in claim 25, including a cover member extending vertically along and over the adjoining edges of at least said plurality of vertically arranged slat members, to cover and conceal such edges.

32. A modular slat-wall structure as recited in claim 25, including a cap-like cover member extending along and over the top portions of said upright supports and said vertically arranged slat members to substantially cover and conceal such top portions.

33. An integrated unitary panel-like member for space-divider and display walls, comprising in combination:

a plurality of individual slat members stacked one upon another in generally vertical alignment;

connecting means extending generally transversely across said slat members and connected thereto to form an integrated unitary panel therefrom; and attachment apparatus for attaching said unitary slat panel to a generally vertical support and securing the panel in place thereupon, whereby said panel comprises at least a segment of such a wall;

wherein said connecting means is mechanically secured to said slat members.

34. A unitary panel-like member as recited in claim 33, wherein said slat members are made of sheet metal.

35. A unitary panel-like member as recited in claim 33, wherein said connecting means is welded to said slat members.

36. A unitary panel-like member as recited in claim 33, wherein said connecting means and said attachment apparatus are fixedly secured together to form a unitary member.

37. A unitary panel-like member as recited in claim 33, wherein said attachment apparatus includes a hanger projection extending away from said slat members, for engaging a complementary receptacle on said generally vertical support.

38. A free-standing, modular slat-wall structure, comprising in combination:

at least two mutually spaced upright supports, each having foot structure for supporting it in an upright position;

a plurality of individual slat members stacked one upon another in generally vertical alignment, at least some of said individual slat members being fixedly secured together to form a unitary panel-like member;

attachment apparatus for attaching said plurality of individual slat members to each of said at least two mutually spaced upright supports to hang said at least some individual slat members upon said at least two upright supports and form a free-standing slat-wall structure of a modular nature which is movable as a unit;

wherein said attachment apparatus includes an elongated member extending generally transversely across at least some of said individual slat members and contacting such slat members to support them in place relative to one another; and wherein said elongated member includes at least one of a pair of mutually engageable hanger structures and at least one of said at least two upright supports including the other of said pair of mutually removable and engageable hanger structures, said pair of mutually engageable hanger structures when mutually engaged serving to support the slat members which are contacted and supported by said elongated member.

39. A modular slat-wall structure as recited in claim 38, wherein the pair of mutually engageable hanger structures are relatively removable.

40. A modular slat-wall structure as recited in claim 39, wherein said at least one of said pair of mutually engageable hanger structures includes a downwardly depending flange and said other of said pair of hanger structures includes an opening; and wherein said downwardly depending flange is configured to be inserted into the opening and slid downward therein to engage the flange with the opening.

41. A modular slat-wall structure as recited in claim 38, wherein said elongated member includes projecting portions which are engageable with said at least some of said slat members to support them in place.

42. A modular slat-wall structure as recited in claim 38, wherein said elongated member includes hanger portions which are movably engageable with cooperating portions of said at least of some said slat members.

43. A modular slat-wall structure as recited in claim 38, wherein said elongated member is fixedly secured to at least certain of said at least some of said slat members to form said unitary panel-like member.

44. A modular slat-wall structure as recited in claim 43, including a mechanical fastening structure between said elongated member and said certain of said individual slat members to fixedly secure them together.

45. A modular slat-wall structure as recited in claim 44, wherein said mechanical fastening structure comprises a weld.

46. A modular slat-wall structure as recited in claim 44, wherein said mechanical fastening structure comprises an adhesive.

47. A modular slat-wall structure as recited in claim 38, including a deck-like panel extending between and substantially covering the foot structure of each of said at least two mutually spaced upright supports at a location below said vertically stacked slat members.

48. A modular slat-wall structure as recited in claim 38, including a cover member extending vertically along and over the adjoining side edges of at least said plurality of vertically stacked slat members, to cover and conceal such edges.

49. A modular slat-wall structure as recited in claim 48, wherein said cover member extends along and over the adjoining side edges of at least some of said vertically stacked slat member and their respective attachment apparatus and upright supports.

50. A modular slat-wall structure as recited in claim 38, including a cap-like cover member extending along and over the top portions of said upright supports and vertically stacked slat members to substantially cover and conceal such top portions.

* * * * *